US007737901B2

(12) United States Patent
Su et al.

(10) Patent No.: US 7,737,901 B2
(45) Date of Patent: Jun. 15, 2010

(54) MULTI-BAND ANTENNA

(75) Inventors: Wen-Fong Su, Tu-Cheng (TW); Hsien-Sheng Tseng, Tu-Cheng (TW); Shang-Jen Chen, Tu-Cheng (TW); Lung-Shena Tai, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 175 days.

(21) Appl. No.: 11/824,784

(22) Filed: Jul. 3, 2007

(65) Prior Publication Data

US 2008/0001826 A1 Jan. 3, 2008

(30) Foreign Application Priority Data

Jul. 3, 2006 (CN) ..... 09 5 124096

(51) Int. Cl.
*H01Q 1/48* (2006.01)
*H01Q 13/10* (2006.01)

(52) U.S. Cl. ..... 343/767; 343/729; 343/846

(58) Field of Classification Search ..... 343/700 MS, 343/702, 829, 767, 795, 846
See application file for complete search history.

(56) References Cited

U.S. PATENT DOCUMENTS 5,828,340 A 10/1998 Johnson
6,661,380 B1 * 12/2003 Bancroft et al. ..... 343/700 MS
7,042,414 B1 5/2006 Lee

* cited by examiner

*Primary Examiner*—Michael C Wimer
(74) *Attorney, Agent, or Firm*—Wei Te Chung; Andrew C. Cheng; Ming Chieh Chang

(57) ABSTRACT

A multi-band antenna, made by an integral plate and comprises a radiating element, a grounding element, a slit formed as part of the plate, and a feeding line; wherein horizontal conductive portion of said plate are separated from each other with said slit between them and serve as the radiating element and the ground element respectively; the feeding line, comprising an inner conductor connected with the radiating element and an outer conductor connected with the grounding element; wherein said radiating element comprising at least two radiating portions defining at least one radiating arm with gradually increasing width, and at least two radiating portion cooperatively acting to achieve a Ultra Wide Band antenna.

18 Claims, 3 Drawing Sheets

MULTI-BAND ANTENNA

BACKGROUND OF THE INVENTION

1. Field of the Invention

The present invention relates generally to a multi-band antenna, and more particularly to a Ultra Wide Band antenna (UWB) used for electronic devices, such as notebooks.

2. Description of the Prior Art

At present, the Bluetooth and the IEEE802.11a/g are two of main wire network technologies. However, both the two wire network technologies have disadvantage that transmitting rate of signals fall down with the increase of transmitting distance. A new technology, Ultra Wide Band (UWB) interknit technology, is used in short-haul signal high-speed transmission and signal low-speed transmission among over 100 m even to 1 km distance. The system in electronic device sends low-intensity and narrow pulse signal but not carrier signal to achieve high quality and high-speed transfer. For this reason, this signal transmission has strong anti-jamming capability, and smaller loss of power and electric. Besides, UWB has a big advantage of big capacity to transmit more data. In Feb. 14, 2002, FCC in USA allowed UWB interknit technology used on consumer electrical products. To achieve Ultra Wide Band transmission, an UWB antenna is designed. The band width of the antenna lies on the impedance matching degree, so the UWB antennas need higher requirement of impedance. In current technique, most of UWB antennas are monopole antennas or dipole antennas. However, present electric devices require small-size, so smaller antenna therein is needed. Plane inverted F antennas, a kind of antennas with small size, are used more and more. U.S. Pat. No. 7,042,414 discloses an UWB antenna with small size as shown by FIG. 1 with label of this patent. The antenna comprises two different radiating elements working on two bands having across frequency band to achieve Ultra Wide band. The first radiating element 31 of the antenna is a plate with a cutout in the middle of itself, and the second radiating element 32 is made by a kind of material different from that of the first radiating element. The second radiating element 32 is located in the cutout of the first radiating element 31, and separated from the first radiating element 31. The UWB antenna has better radiation properties, but the radiating elements of the antenna and the grounding element are divided into two parts which are not connected with each other. So the radiating elements and the grounding element must be fastened through a PCB, thus, the structure of the antenna is complex. U.S. Pat. No. 5,828,340 discloses a wide band antenna as shown by its FIG. 1 with label. The wide band antenna comprises a plate 10 with a cone shape angle 20 and being located on the substrate 4, a grounding element 14 and a feeding line 12. The wide band antenna 2 is able to achieve frequencies lower or higher than the center frequency 40%. However, the radiating element of the wide band antenna is made of an integral planar plate 10 resulted in the volume of the antenna is big.

Hence, an improved antenna is desired to overcome the above-mentioned shortcomings of the existing antennas.

BRIEF SUMMARY OF THE INVENTION

A primary object, therefore, of the present invention is to provide a multi-band antenna which is able to achieve an Ultra Wide Band antenna with small-size and simple manufacture.

In order to implement the above object and overcomes the above-identified deficiencies in the prior art, the multi-band antenna, made by an integral plate and comprises a radiating element, a grounding element, a slit formed as part of the plate, and a feeding line, wherein horizontal conductive portion of said plate are separated from each other with said slit between them and serve as the radiating element and the ground element respectively; the feeding line comprises an inner conductor connected with the radiating element and an outer conductor connected with the grounding element; wherein said radiating element comprising at least two radiating portions defining at least one radiating arm with gradually increasing width, and at least two radiating portions cooperatively acting to achieve a Ultra Wide Band antenna.

In order to implement the above object and overcomes the above-identified deficiencies in the prior art, the multi-band antenna made by an integral plate and comprises a radiating element, a grounding element, a slit formed and a feeding line; the slit as part of the plate, comprising a close groove, and wherein horizontal conductive portion of said plate are separated from each other with said slit between them and serve as the radiating element and the ground element respectively; a feeding line, comprising an inner conductor connected with the radiating element and an outer conductor connected with the grounding element; wherein said radiating element comprising at least two radiating portions defining at least one radiating arm with gradually increasing width, and said at least two radiating portion cooperatively acting to achieve a Ultra Wide Band antenna.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
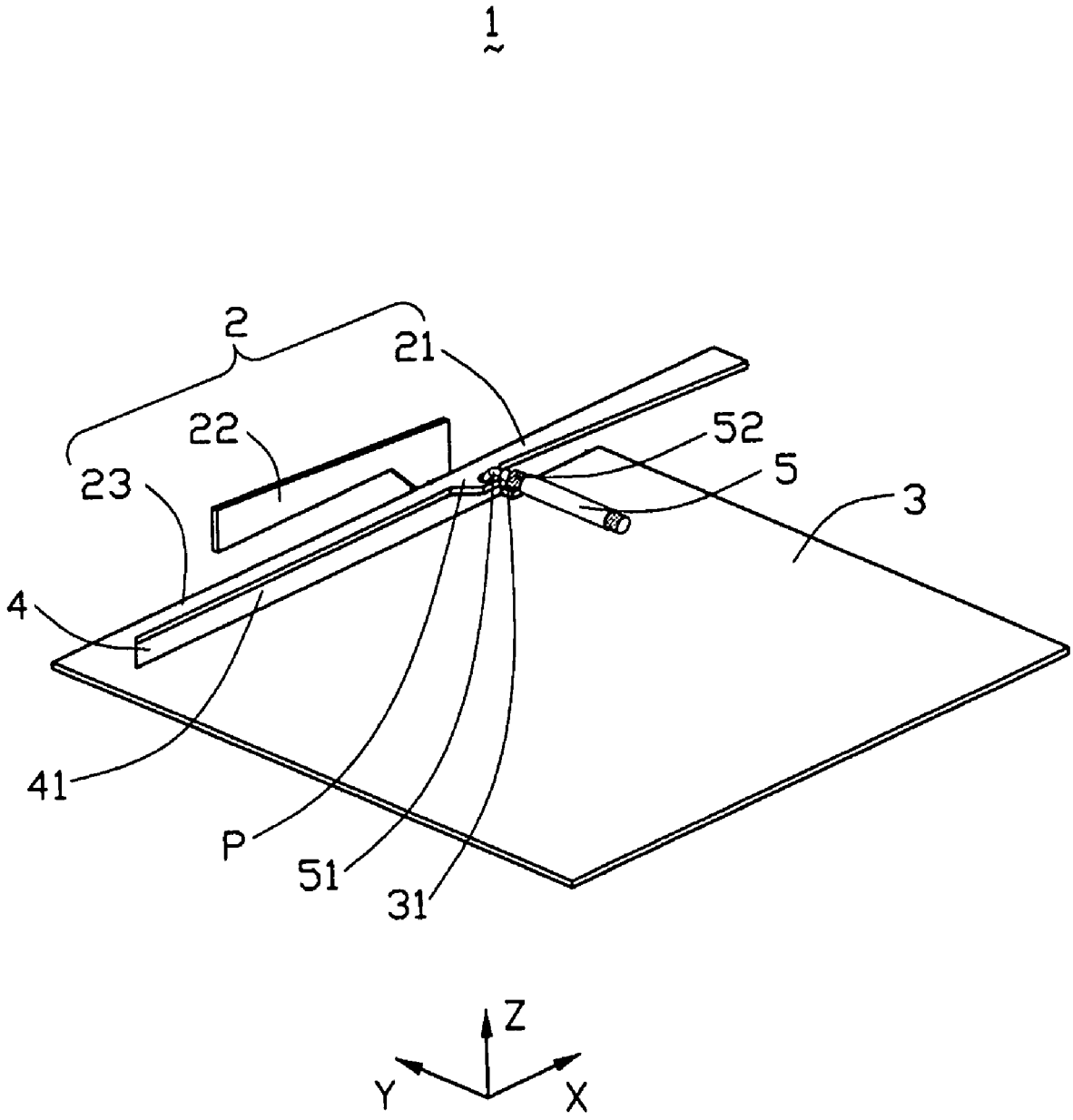
FIG. 1 is a perspective view illustrating a preferred embodiment of the present invention.
Figure 2:
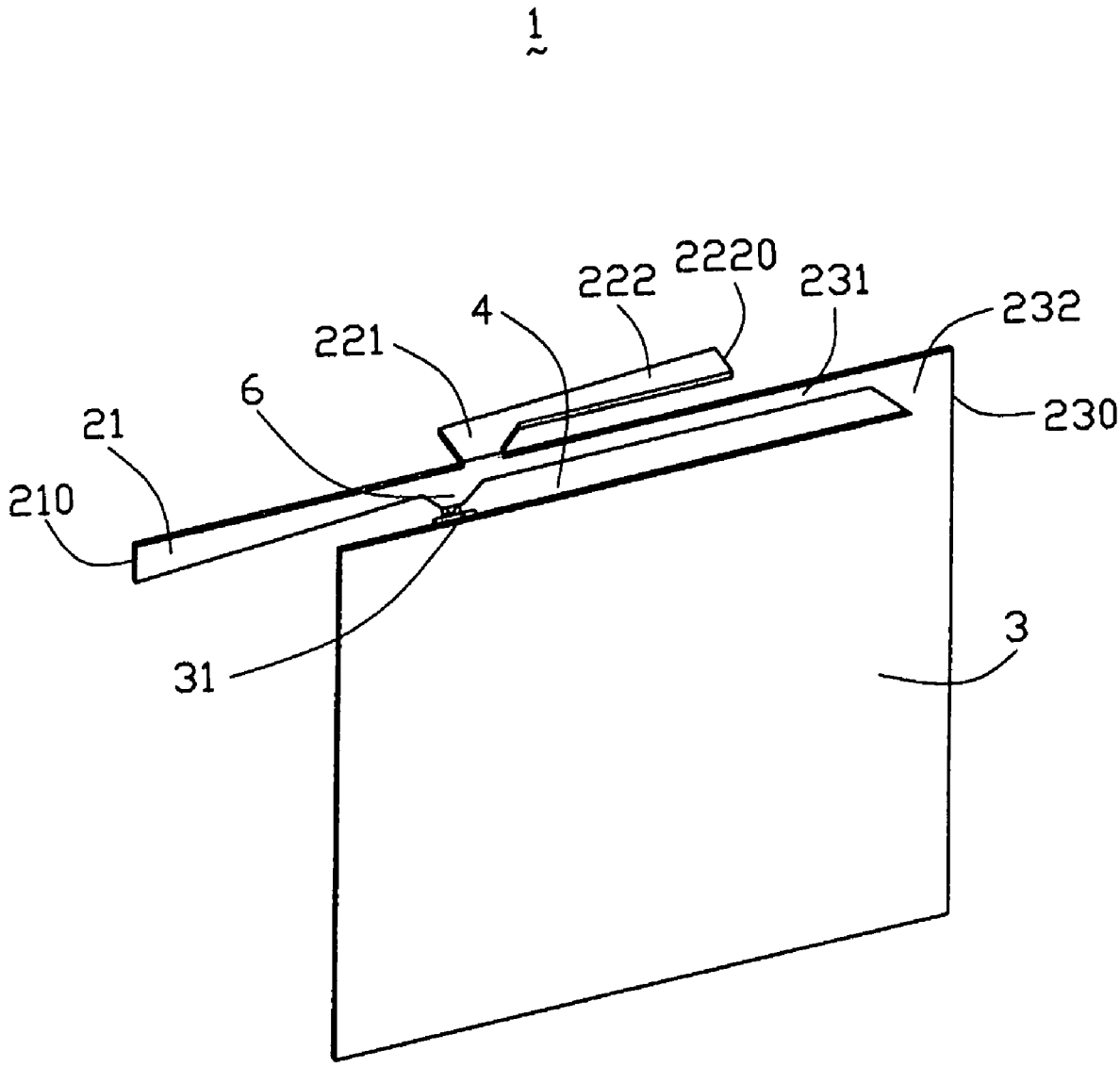
FIG. 2 is a view similar to FIG. 2, but take from a different aspect.

Reference to FIG. 1 to FIG. 2, perspective views of a multi-band antenna 1 in accordance with a preferred embodiment of the present invention are shown.

The multi-band antenna 1 is a planar invert-F antenna 1, and is made by cutting and slitting a plate. The multi-band antenna comprises a radiating element 2, a large-size planar grounding element 3, a slit 4, a feeding line 5 and a protrusion 6. The radiating element 2 and the grounding element 3 are respectively located at the two opposite sides of the slit 4, and one end of the radiating element 2 is connected with the grounding element 3.

The radiating element 2 of the multi-band antenna 1 consists of metal sheets with certain lengths, and connecting with one and another and comprises a first radiating portion 21, a third radiating portion 23 which is connected with the first radiating portion 21 on point P and located in a first plane same as that of the first radiating portion 21, and a second radiating portion 22 vertically extending from the third radiating portion 23 to located in a second plane perpendicular to the first plane. The first radiating portion 21 is a tapered radiating portion and extends from the point P to a first end 210. The width of the first radiating portion 21 is broadened gradually with the length increase from the point P to the first end 210. The second radiating portion 22 firstly extends upward form the joint of the first radiating portion 21 and the third radiating portion 23 to form a first radiating arm 221 whose width is gradually broadened from bottom to up. A second radiating arm 222 with gradually broadened width extends vertically from the first radiating arm 221 in the second plane, and forms a second end 2220. On the joint point of the first radiating arm 221 and the second radiating arm 222, the width of the second radiating arm 222 is narrower than that of the first radiating arm 221. The third radiating portion 23 comprises a rectangle plate 231 defined a third end 230 opposite to the first end 210, and a tapered radiating arm 232. The tapered radiating arm 232 is shown as trapeze shape and extends form the rectangle plate 231 in a direction perpendicular to the rectangle plate 231 to connect with the grounding element 3. The rectangle plate 231 and the tapered radiating arm 232 are respectively located on the two sides of the slit 4 defined between the radiating elements 2 and the grounding element 3. Thus, in this embodiment of the present invention, the first radiating portion 21, the third radiating portion 23, the grounding element 3 and the protrusion 6 are on the first plane and extend toward the grounding element 3, and the second radiating portion 22 is located on the second plane vertical to the first one. The first radiating portion 21 extends along the first plane beyond the grounding element 3.

The grounding element 3 is rectangular shape, and comprises a grounding tab 31. The feeding line 5 comprises an inner conductor 51 and an outer conductor 52. The outer conductor 52 is connected to the grounding tab 31 to form a grounding point. The slit 4 comprises a close groove 41 and an open groove (not graded). The feeding line 5 together with the grounding element 3 and the third radiating portion 23 encircles a close groove 41 on the slit 4. The open groove is formed by the first radiating portion 21, the feeding line 6 and the grounding element 3.

Figure 3:
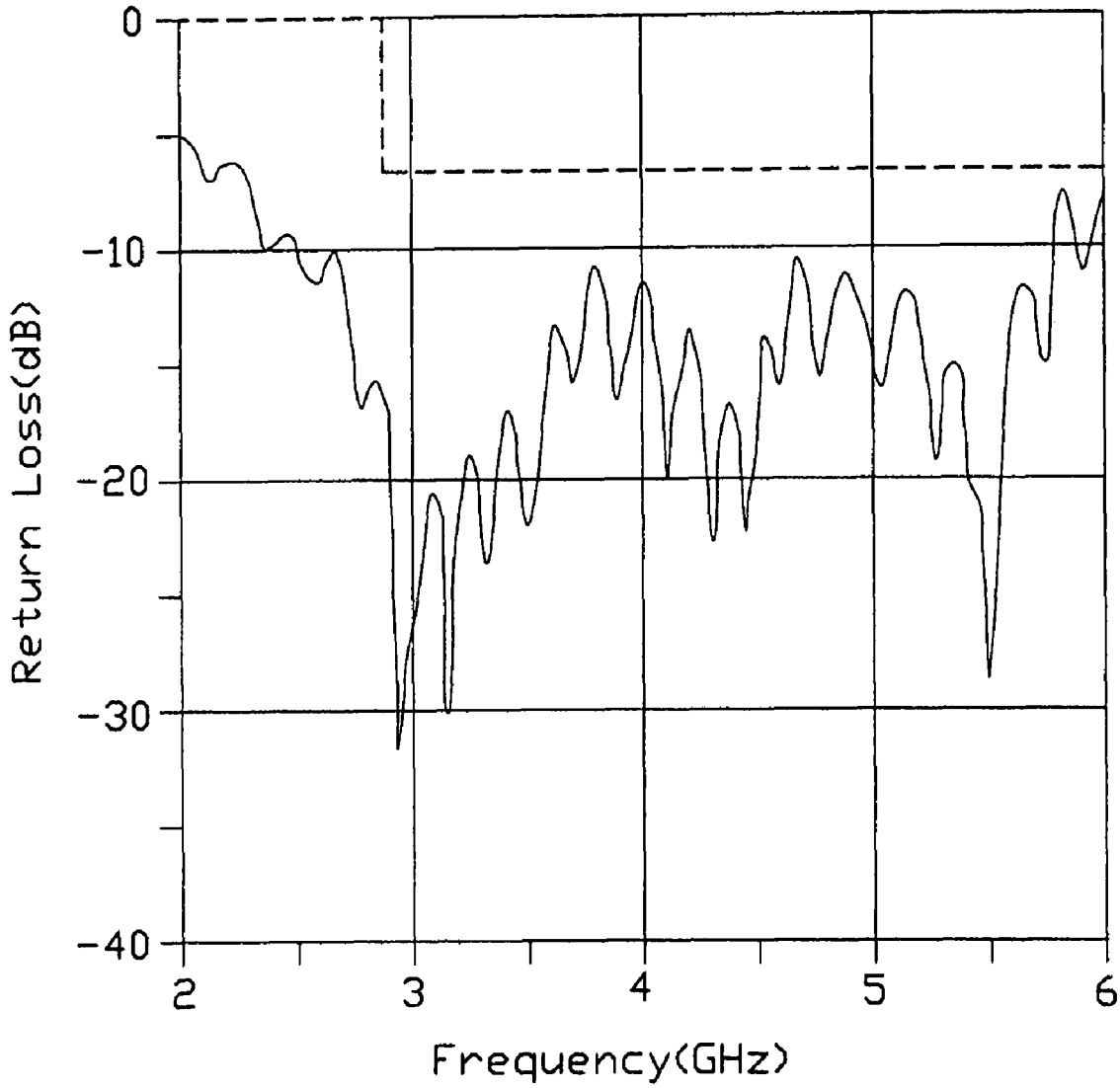
FIG. 3 is a test chart recording of Voltage Standing Wave Ratio (VSWR) of the present invention.

In this embodiment of the present invention, the first radiating portion 21 creates a first frequency resonance whose center frequency is 3.2 GHz. The second radiating portion 22 creates a second frequency resonance whose center frequency is 4.5 GHz. The third radiating portion 23, the grounding element 3 and the close groove 41 jointly create a third frequency resonance whose center frequency is 5.5 GHz. The entire first radiating portion 21, the second radiating portion 22 and the third radiating portion 23 have gradually-increasing-width structure, and this structure is good for impedance match to increase the band width of the radiating portions. So every two frequency bands of the radiating portions are joined to perform an ultra wide band antenna. Reference to FIG. 3, a VSWR chart accordance with this embodiment of the present invention is shown. The multi-band antenna 1 is able to across a frequency band from 2.904 GHz to 6.0 GHz. So the multi-band antenna 1 can meet the demand of the UWB antenna.

In this embodiment of the present invention, the multi-band antenna 1 broadens the band width of the radiating portions through a special structure to make each two frequency bands of the radiating portion joined to achieve a UWB antenna. In manufacturing process, an integer plate is cut and bent to form the multi-band antenna 1. The multi-band antenna 1 has simple structure, conveniently manufacturing process and compact size. In alternative embodiments, the structures of the radiating portions can be not only changed from broad to narrow, but also changed to other shape to adapt to the inner space of the electronic device. And the position of the feeding point and the grounding point can be changed to match impedance.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-band antenna, made by an integral plate and comprising:

a radiating element;

a grounding element;

a slit formed between the radiating element and the grounding element;

a feeding line, comprising an inner conductor connected with the radiating element and an outer conductor connected with the grounding element;

wherein said radiating element comprising at least two first and second radiating portions defining at least one radiating arm with gradually increasing width, and said at least two first and second radiating portions cooperatively acting to achieve a Ultra Wide Band antenna;

further comprising a third radiating portion connected with the grounding element, said first radiating portion extending from the third radiating portion and said second radiating portion extending from the third radiating portion.

2. The multi-band antenna as claimed in claim 1, wherein said first radiating portion with said third radiating portion forms a longwise metal arm, and said slit is between the longwise metal arm and the grounding element.

3. The multi-band antenna as claimed in claim 1, wherein said each of the two first and second radiating portions comprises a gradually-increasing-width radiating arm.

4. The multi-band antenna as claimed in claim 1, wherein said first radiating portion extends from the third radiating portion in a parallel direction and located in the same plane as that of the third radiating portion, said second radiating portion extends from the third radiating portion in a direction perpendicular to the third radiating portion and located in a different plane from that of the third radiating portion.

5. The multi-band antenna as claimed in claim 1, wherein said first radiating portion is a tapered plate, and comprises a protrusion extending from the joint of the first radiating portion and the third radiating portion to connect with said feeding line.

6. The multi-band antenna as claimed in claim 1, wherein said second radiating portion comprising a tapered first radiating portion and a tapered second radiating portion, and the first radiating portion extending from the third radiating portion and the second radiating portion extending from the first radiating portion.

7. The multi-band antenna as claimed in claim 1, wherein said first radiating portion, third radiating portion are on the first plane, and the second radiating portion is located on the plane vertical to the first plane.

8. The multi-band antenna as claimed in claim 1, wherein said first radiating portion extends beyond said grounding element.

9. The multi-band antenna as claimed in claim 8, wherein said third radiating portion comprising a rectangle plate and a tapered radiating arm located on one side of the grounding element opposite to the rectangle plate, and the tapered radiating arm is tapered trapeze shape and extends to connect with the grounding element.

10. The multi-band antenna as claimed in claim 9, wherein said feeding line with the grounding element and the third radiating portion encircles a closed groove on the slit.

11. The multi-band antenna as claimed in claim 10, wherein said first radiating portion creates a first frequency resonance, the second radiating portion creates a second frequency resonance, and the third radiating portion, the grounding element and the closed groove jointly create a third frequency resonance.

12. The multi-band antenna as claimed in claim 11, wherein said first frequency resonance's center frequency is 3.2 GHz, the second frequency resonance's center frequency is 4.5 GHz, and the third frequency resonance's center frequency is 5.5 GHz.

13. The multi-band antenna as claimed in claim 11, wherein a band width of the multi-band antenna is across 2.904 GHz to 6.0 GHz.

14. A multi-band antenna, made by an integral plate and comprising:

a radiating element;

a grounding element;

a slit, comprising a closed groove; and a feeding line, comprising an inner conductor connected with the radiating element and an outer conductor connected with the grounding element;

wherein said closed groove is surrounded by the radiating element, the grounding element and the feeing line; wherein said radiating element comprises at least two first and second radiating portions with at least two first and second radiating arms spaced apart from the grounding element, and a third radiating portion connected with the grounding element, the first radiating portion extending from the third radiating portion and the second radiating portion extending from the third radiating portion.

15. The multi-band antenna as claimed in claim 14, wherein at least one of said first and second radiating arms with gradually increasing width and said at least two first and second radiating portions cooperatively acting to achieve a Ultra Wide Band antenna.

16. The multi-band antenna as claimed in claim 14, wherein said the slit also comprises an open portion which is differentiated from the closed groove.

17. The multi-band antenna as claimed in claim 16, wherein said open portion is formed by the first radiating portion, the feeding line and the grounding element.

18. A multi-band antenna comprising:

an integral plate defining a grounding element and a radiating element thereon;

a first slot formed in the plate adjacent to an edge of the plate to separate said grounding element and said radiating element;

a point defined on the radiating element, on which a feeding cable is connected and by which a first radiating section and a second radiating section are defined;

a third radiating section extending from said edge about said point in an angled manner with regard to the plane defined by said grounding element; and a second slot is formed between the third radiating section and said edge; wherein the first slot and the second slot extend in opposites directions.

* * * * *